US005611445A

United States Patent [19]

Kano et al.

[11] Patent Number: 5,611,445

[45] Date of Patent: Mar. 18, 1997

[54] LID FOR CONTAINER

[75] Inventors: Takashi Kano, Yamagata; Seizo Rai, Yashio, both of Japan

[73] Assignee: Mect Corporation, Tokyo, Japan

[21] Appl. No.: 500,876

[22] PCT Filed: Jan. 25, 1994

[86] PCT No.: PCT/JP94/00094

§ 371 Date: Aug. 4, 1995

§ 102(e) Date: Aug. 4, 1995

[87] PCT Pub. No.: WO94/18088

PCT Pub. Date: Aug. 18, 1994

[30] Foreign Application Priority Data

Feb. 5, 1993 [JP] Japan ..... 5-017746

[51] Int. Cl.[6] ..... B65D 41/62

[52] U.S. Cl. ..... 215/249; 215/251

[58] Field of Search ..... 215/249, 250, 215/251

[56] References Cited

U.S. PATENT DOCUMENTS

| | | | |
|---|---|---|---|
| 3,379,326 | 4/1968 | Andersen | 215/249 |
| 3,480,171 | 11/1969 | Rohde | 215/251 |
| 4,244,478 | 1/1981 | Handman | 215/249 |
| 4,784,279 | 11/1988 | Osting et al. | 215/251 |
| 4,863,049 | 9/1989 | Suzuki et al. | 215/249 |
| 5,080,245 | 1/1992 | Conard | 215/249 |
| 5,114,030 | 5/1992 | Conard | 215/249 |

FOREIGN PATENT DOCUMENTS

| | | | |
|---|---|---|---|
| 2101105 | 1/1983 | United Kingdom | 215/251 |

*Primary Examiner*—Stephen K. Cronin
*Attorney, Agent, or Firm*—McCormick, Paulding & Huber

[57] ABSTRACT

A lid for a container, which is easy for separated disposal. The lid has a main body portion (1*a*) and a projected portion (1*b*) integrally formed at the substantially central portion of the upper surface (1*a*1) of the main body portion (1*a*), whereby the lid (1) for the container covers an opening portion of a bottle (container) (2) and a seal plug for blocking this opening portion., wherein there are provided: a first annular thin wall thickness portion (breakable portion) (5), for bending the projected portion (1*b*), with a remaining portion thereof, on the circumference of a base portion of the projected portion (1*b*); a second thin wall thickness portion (breakable portion) (6) extending from one end of the first thin wall thickness portion (5) through the upper surface (1*a*1) of the main body portion (1*a*) to the bottom end of the outer peripheral surface (1*a*2); a third thin wall thickness portion (breakable portion) (7) extending from the other end of the first thin wall thickness portion (5) to the end of the outer periphery of the upper surface (1*a*1); and a fourth thin wall thickness portion (breakable portion) (8) extending from an intermediate point of the first thin wall thickness portion (5) to the end of the outer periphery of the upper surface (1*a*1) of the main body portion (1*a*).

4 Claims, 4 Drawing Sheets

LID FOR CONTAINER

TECHNICAL FIELD

This invention relates to a lid for a container, and more particularly to a technique effectively applied to a lid of a bottle for chemical liquid such as a so-called vial.

BACKGROUND ART

For example, as for a lid used in a bottle for chemical liquid, there are various ones including so-called flip-off cap and pull-top cap.

From among these various lids, there is one provided on the top of a main body portion thereof with a projected portion. The lid of this type has a satisfactory controllability because the lid can be opened when the projected portion is pushed by a finger. Because it is useful when the lid is used in quantities in particular, the lids of this type are used often as lids of bottles for chemical liquid and the like.

As shown in FIG. 4, such a construction has heretofore been adopted that an annular thin wall thickness portion (breakable portion) 15 is formed over the whole circumference of a base portion of a projected portion 11*b*, and the projected portion 11*b* is bent at the thin wall thickness portion 15 whereby the projected portion 11*b* is pushed and bent, so that the projected portion 11*b* can be bent and removed from a main body portion 11*a*.

Now, there is a worldwide trend of that the limited resources are effectively utilized, so that things being tender for the earth should be created.

It goes without saying the above-described fact, and produced articles of trade are required to be sold in forms capable of being recycled as much as possible.

However, when the above-described lid is observed from the viewpoint of this side, in the lid 11 for the container, from which the projected portion 11*b* is bent and removed, the remaining main body portion 11*a* is firmly engaged with an opening portion of a container 12, so that it is not easy to separate the main body portion. This makes it difficult the separated disposal of the lid 11 for the container, the container 12 and a seal plug for tightly sealing the opening portion of the container 12, all of which are formed of different materials from one another.

Furthermore, description has been given of that the flip-off cap is included in the lids used in bottles for chemical liquid. This flip-off cap is constructed such that an aluminum cap is engaged with the undersurface of a plastic cap and the cap is opened in a state where a ring-shaped aluminum piece, separated by a bridge formed in an annular slit, is secured to the plastic cap. It is not easy to separate this secured aluminum piece from the plastic cap and the separated disposal is still difficult.

Then, even if the recycling of the component parts themselves is possible, the difficulties of the separated disposal as described above mean that the recycling is substantially impossible.

Then, it is an object of the present invention to provide a technique relating to a lid for a container, which is easy for separated disposal.

The above-described and other objects and novel features of the present invention will become apparent more fully from the description of the specification in conjunction with the accompanying drawings.

DISCLOSURE OF THE INVENTION

The following is the description of outlines of typical ones out of the inventions disclosed in the present application.

That is, a lid for a container according to the present invention is constructed such that the lid has a main body portion and a projected portion integrally projected from the substantially central portion of the upper surface of this main body portion, whereby an opening portion of the container and a seal plug for blocking the opening portion are covered by the lid. The lid comprises: a first breakable portion, for bending the projected portion, annularly provided on the circumference of a base portion of the projected portion with a remaining portion thereof; a second breakable portion provided from one end of the first breakable portion through the upper surface of the main body portion to the bottom end of the outer peripheral surface of the main body portion; a third breakable portion provided from the other end of the first breakable portion to the end of the outer periphery of the upper surface of the main body portion; and at least one fourth breakable portion provided from an intermediate point of the first breakable portion to the end of the outer periphery of the upper surface of the main body portion.

In this case, a display mark for indicating a bending direction of the projected portion may be provided on the upper surface of the main body portion for example.

Further, the above-described lid for the container may be integrally formed of a single material of metal or synthetic resin.

Furthermore, in this case, the above-described container may be made to be a bottle for chemical liquid.

With the lid for the container having the above-described arrangement, in the use, the projected portion is pushed, whereby the projected portion is torn at the first breakable portion formed at the base portion thereof, so that the projected portion is bent in a state where the projected portion is connected to the main body portion through an area, where a breakable portion is not formed, at the base portion.

Then, in order to place the container at disposal, the projected portion is pulled, whereby, firstly, the projected portion is torn at the second and third breakable portions, so that the main body portion is broken in a radial direction. When the projected portion is further pulled, the projected portion is broken at the fourth breakable portion, whereby the outer peripheral surface of the main body portion is turned into a wavy shape and separated from the container.

Furthermore, the seal plug is fixed to the top surface of the opening portion of the container by the upper surface of the lid, whereby, when the lid for the container is separated from the container, the seal plug can be separated from the container.

Then, the lid for the container, the container and the seal plug are separated from one another and placed at disposal, so that these parts can be recycled.

BEST MODE FOR CARRYING OUT THE INVENTION

Figure 1:
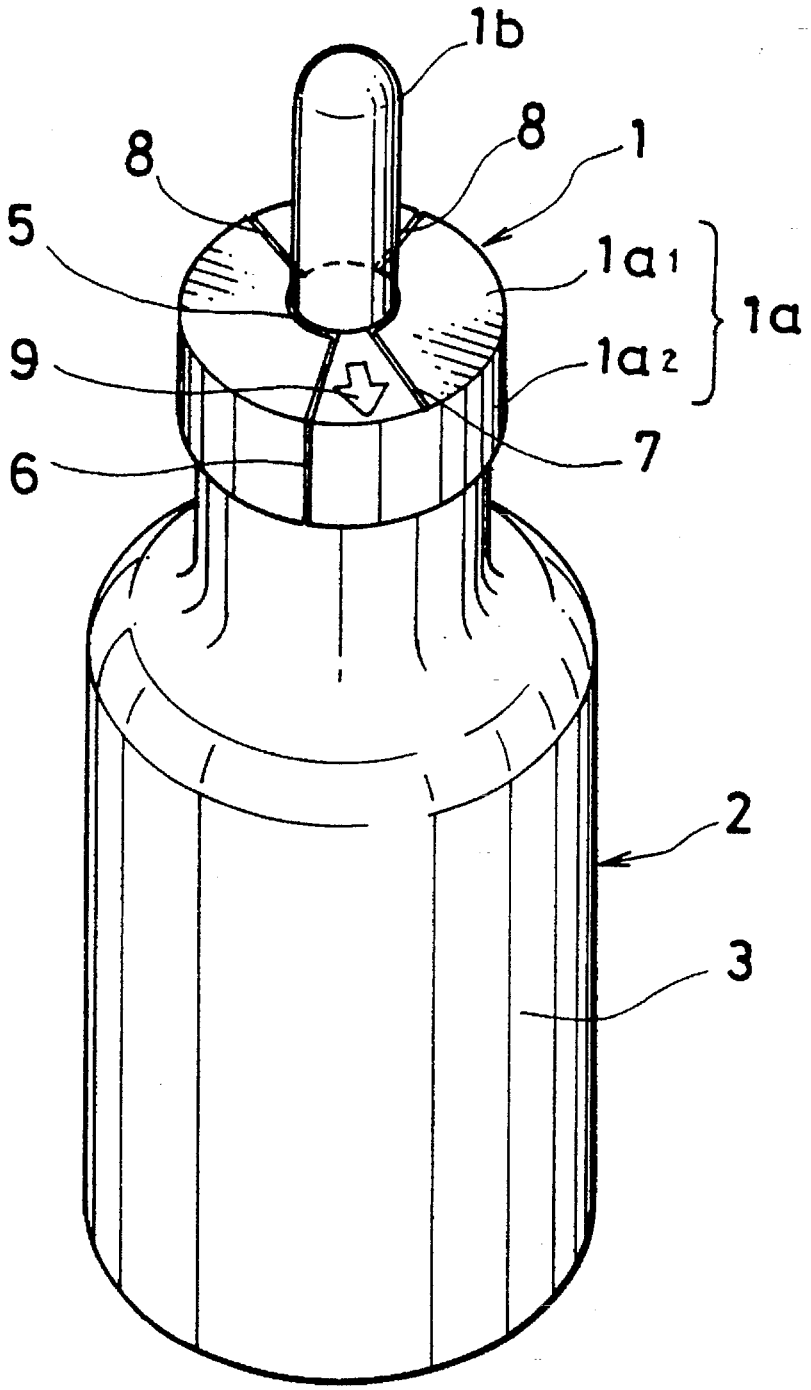
FIG. 1 is an oblique view showing a container, to which is fastened a lid for a container as being an embodiment of the present invention.
Figure 2:
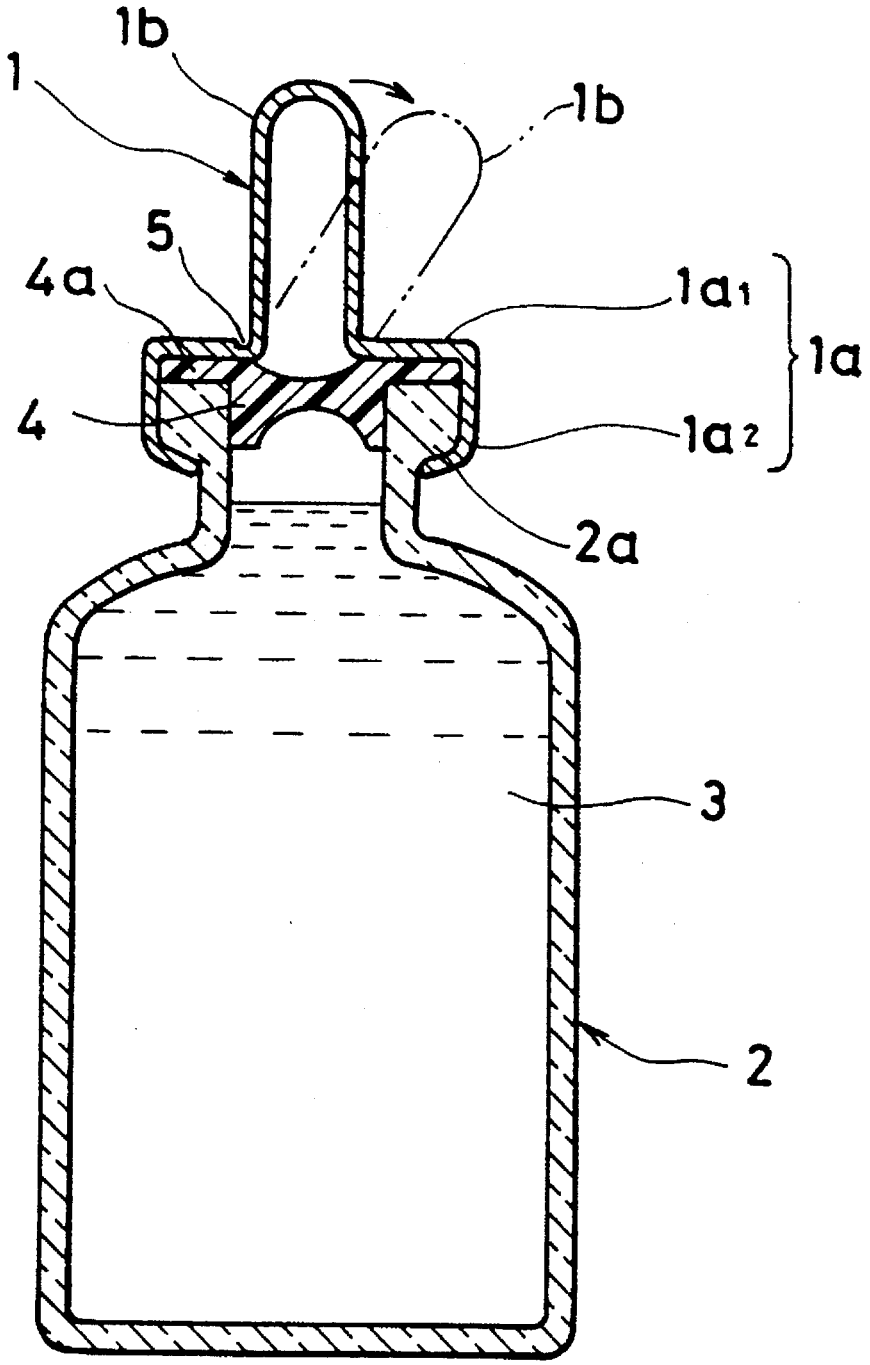
FIG. 2 is a sectional view showing the container, to which is fastened the lid for the container as shown in FIG. 1.
Figure 3:
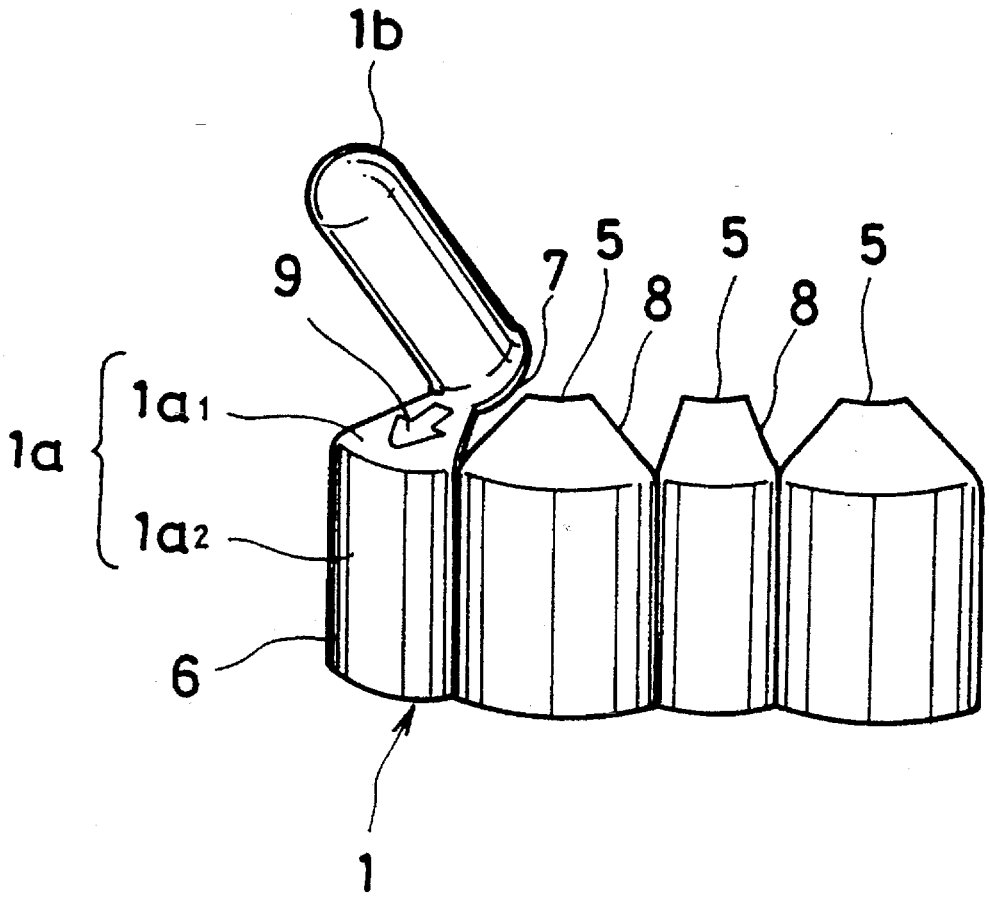
FIG. 3 is an oblique view showing the lid for the container, which is removed from the container shown in FIG. 1.
Figure 4:
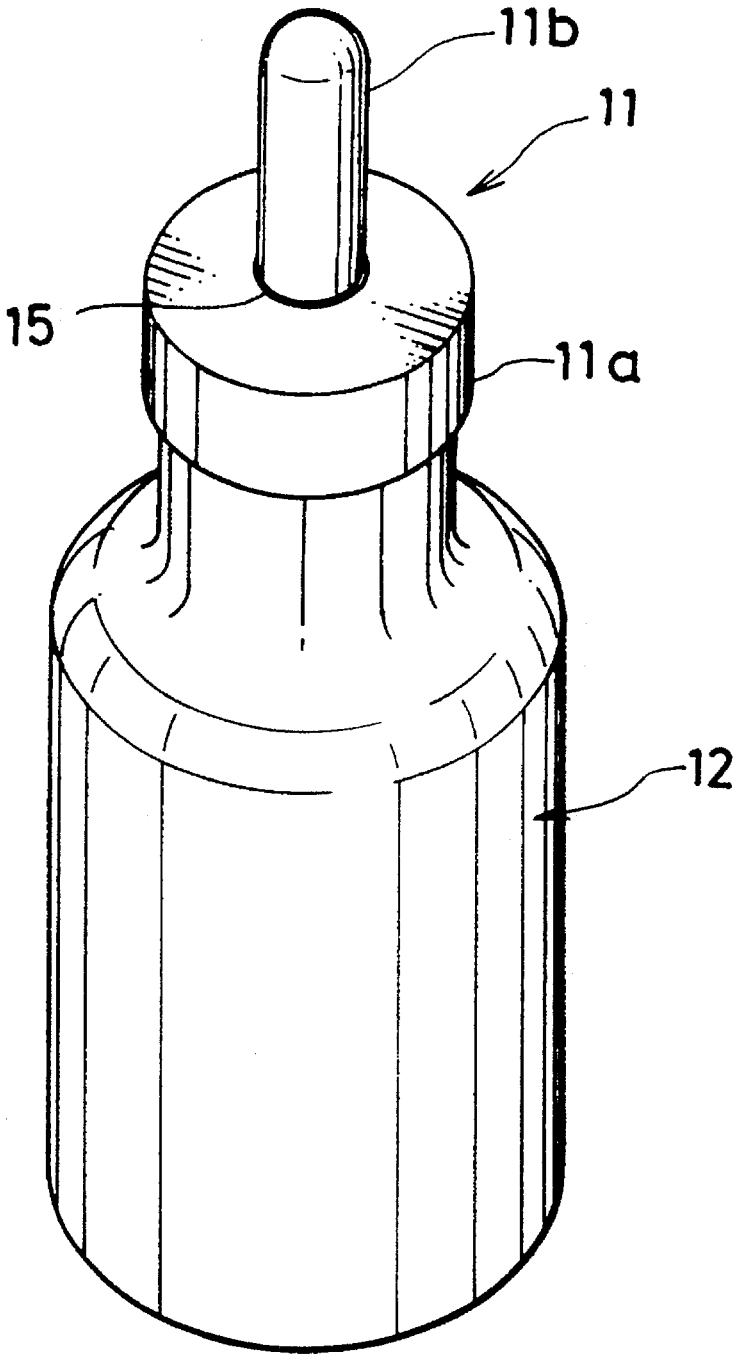
FIG. 4 is an oblique view showing a container, to which is fastened a conventional lid for a container.

FIG. 1 is the oblique view showing the container, to which is fastened the lid for the container as being one embodiment of the present invention, FIG. 2 is the sectional view showing the container, to which fastened the lid for the container, and FIG. 3 is the oblique view showing the lid for the container, which is removed from the container.

Firstly, description will be given of the arrangement of the lid for the container as shown in this embodiment.

A lid for a container in this embodiment (hereinafter simply referred to as a "lid") 1 is applied to tightly sealing a bottle (container) 2 for chemical liquid for example.

A predetermined amount of chemical liquid 3 is sealed into the bottle 2 and a seal plug 4 made of rubber for example is coupled to the forward end of an opening portion 2*a* of this bottle 2, whereby the interior of the bottle 2 is tightly sealed and shut off from the exterior.

The opening portion 2*a* and the seal plug 4 of the bottle 2 are covered by the lid 1, so that the seal plug 4 is prevented from coming off freely and foreign matters are prevented from intruding prior to the opening of the seal.

The lid 1 is made as a cap member integrally formed of a metal material such for example as aluminum, and it includes: a main body portion 1*a* having a substantially flat upper surface 1*a*l for clamping and fixing a flange portion 4*a* of the seal plug 4 to the top surface of the opening portion 2*a* of the bottle 2 and an outer peripheral surface 1*a*2 extending downward from the end of the outer periphery of this upper surface 1*a*l so as to cover the outer side surface of the opening portion 2*a* of the bottle 2 and being staked inwardly at the bottom end thereof to fix the lid 1 to the opening portion 2*a* of the bottle 2, and a round headed cylindrical projected portion 1*b* being projected upwardly from the substantially central portion of the upper surface 1*a*l of the main body portion 1*a* by a predetermined length.

This projected portion 1*b* is provided for being pushed by the inner side of a thumb for example to be bent when the seal of the bottle 2 is opened.

In this embodiment, in order to perform a bending operation of this projected portion 1*b*, a substantially C-letter shaped concave first thin wall thickness portion (breakable portion) 5 recessedly provided by half press for example is formed with a portion of an area, where the breakable portion is not formed, remaining at a base portion (route portion) of the projected portion 1*b*.

Then, there are formed a second thin wall thickness portion (breakable portion) 6 continuously extending from one end of this first thin wall thickness portion 5 through the upper surface 1*a*l of the main body portion 1*a* to the bottom end of the outer peripheral surface 1*a*2 and a third thin wall thickness portion (breakable portion) 7 extending from the other end of the first thin wall thickness 5 to the end of the outer periphery of the upper surface 1*a*l of the main body portion 1*a*. Further, there are formed two fourth thin wall thickness portions (breakable portions) 8 extending from an intermediate portion of the first thin thickness portion 5 to the end of the outer periphery of the upper surface 1*a*l of the main body portion 1*a* in the same manner as the third thin wall thickness portion 7.

Incidentally, since the first, second, third and fourth thin wall thickness portions 5, 6, 7 and 8 do not extend through the main body portion 1*a*, foreign matters are completely prevented from intruding into the interior of the lid 1 through these thin wall thickness portions 5, 6,7 and 8.

A display mark 9 for indicating a bending direction at the time of bending the projected portion 1*b* is carved on the upper surface 1*a*l of the main body portion 1*a*.

Description will hereunder be given of the action of this embodiment.

The lid 1 for the container is formed of the metal material by press, and, at this time, the above-described first, second, third and fourth thin wall thickness portions 5, 6, 7 and 8 are formed by half press simultaneously.

Then, after the chemical liquid 3 is poured into the bottle 2, the seal plug 4 is coupled to the opening portion 2*a*, and further, the lid 1 is coupled thereon and the bottom end of the outer peripheral surface 1*a*2 of the main body portion 1*a* of the lid 1 is staked inwardly, whereby the lid 1 is fixed to the opening portion 2*a* of the bottle 2 and the flange portion 4*a* of the seal plug 4 is clamped between the top surface of the opening portion 2*a* and the upper Surface 1*a*1 of the main body portion 1*a*.

When the seal of the bottle 2 is opened to take out the chemical liquid 3 in the bottle 2, to which the seal plug 4 and the lid 1 are fastened as described above, grasping the bottle 2 by a palm of a hand, pressing a portion of the projected portion 1*b* of the lid, which is close to the upper portion thereof for example by a portion of a thumb on the side of the palm, and pushing the projected portion 1*b* from a position indicated by solid lines in FIG. 2 to a direction indicated by two-dot chain lines in accordance with the display mark 9.

With this operation, the projected portion 1*b* is easily torn at the first thin wall thickness portion 5 at the base portion, and is easily bent from the main body portion 1*a* of the lid 1 at this first thin wall thickness portion 5 in one touch manner.

Thereafter, when the chemical liquid 3 is taken out of the bottle 2, the chemical liquid 3 can be easily and sanitarily taken out by sticking an injection syringe into the seal plug 5.

Then, when the chemical liquid 3 in the bottle 2 is completely taken out and the bottle 2 is placed at disposal, the lid 1 fixed to the opening portion 2*a* of the bottle 2 is separated from the bottle 2, and further, the seal plug 4 fixed to the top surface of the opening portion 2*a* of the bottle 2 by the upper surface 1*a*l of this lid 1 is also separated from the bottle 2, so that the seal plug 4 is placed at the separated disposal.

That is, in order to separate the lid 1 from the bottle 2, it is sufficient to grasp the bottle 2 by the palm of one hand and to hold and pull the projected portion 1*b* by the other hand. In the use, the projected portion 1*b* is torn at the first thin wall thickness portion 5 at the base portion thereof and connected to the main body portion 1*a* through the area, where the breakable portion is not formed, at the base portion.

Here, as described above, the lid 1 is further provided thereon with the second, third and fourth thin wall thickness portions 6, 7 and 8, and the projected portion 1*b* is pulled, whereby, firstly, the lid 1 is torn at the second and third wall thickness portions 6 and 7, so that the main body portion 1*a* is broken in the radial direction. Further, the projected portion 1*b* is pulled, whereby the lid 1 is broken at the fourth thin wall thickness portion 8, so that the outer peripheral surface 1*a*2 of the main body portion 1*a* is turned into a wavy shape and separated from the bottle 2 as shown in FIG. 3.

Furthermore, the seal plug 4 is fixed to the top surface of the opening portion 2*a* of the bottle 2 by the upper surface 1*a*l of this lid 1, whereby the seal plug 4 can be easily separated from the bottle 2 by the separation of the lid 1 from the bottle 2.

Then, the lid 1, the bottle 2 and the seal plug 4 are separated from one another and placed at disposal, so that these parts can be recycled.

The detailed description has hereinbefore been given of the invention invented by the present inventors with reference to the embodiments, however, the present invention should not necessarily be limited to the above embodiments, and it is needless to say that the present invention may be variously modified within a limit not departing from the technical gist.

For example, as for the shape of the projected portion 1*b*, the lid in this embodiment is formed to be a substantially cylindrical shape and the forward end thereof has the round head, however, various shapes of the projected portions can be thought of, which include a prismatic one, a conical one, one whose forward end has a flat head and one formed at one side thereof with a flat surface.

Furthermore, the lid 1 may be made of metals other than aluminum or synthetic resin. For the first, second, third and fourth thin wall thickness portions, 5, 6, 7, and 8, desirable methods such as molding other than the half press may be adopted, and the sectional shape thereof may be convex shape other than the concave shape, and further, a broken line thin wall thickness portion or a sewing machine perforations-like thin wall thickness portion other than the solid line thin wall thickness portion may be adopted. Then, in this embodiment, the two fourth thin wall thickness portions 8 are formed, however, one or more than three fourth thin wall thickness portions may be formed. However, if the torn shape of the upper surface 1*a*l of the main body portion 1*a* is less than a semi-circle, then the lid 1 can be easily separated from the bottle.

As for the display mark 9 for indicating the bending direction of the projected portion 1*b*, the display mark 9 should not necessarily be limited to the arrow-shaped one carved on the upper surface 1*a*l of the main body portion 1*a* as shown in this embodiment, and various methods may be thought of as far as the function of indicating the bending direction can be performed.

For example, pasting by a seal other than carving on the projected portion or a long triangle other than the arrow-shape may be adopted, and, as for the position of display, various portions on the lid may be selected.

Further, in the case where the lid 1 is made of metal, the lid 1 may be easily colored by plating, and, in the case where the lid 1 is made of synthetic resin, the lid 1 may be easily colored by addition of pigment, whereby types of products may be identified by color.

Then, the present invention can be widely applied to the lids for various containers such for example as containers for powder, frozen and dried products other than the bottle for the chemical liquid.

The following is the brief description of the effects obtained by typical ones out of the inventions disclosed in the present application. (1) That is, with the lid for the container according to the present invention, in the use, at the time of disposal, the projected portion being torn at the first breakable portion and being bent in the state where the projected portion is connected through the area, where the breakable portion is not formed, at the base portion is pulled, whereby the projected portion is torn at the second and third breakable portions and the main body portion is broken in the radial direction, and further, broken at the fourth breakable portions and the outer peripheral surface of the main body portion is turned into a wavy shape to be easily separated from the container. Furthermore, the lid for the container is separated from the container, so that the seal plug can be separated from the container. (2) Then, with the above-described lid for the container, the lid for the container itself, the container and the seal plug can be easily separated from one another, whereby the separated disposal can be easily performed as being different from the conventional flip-off cap, so that recycling of these parts can be substantially performed. (3) Accordingly, the articles of trade capable of being recycled are produced and sold, so that it becomes possible to effectively utilize the resources. (4) Particularly, in the case where the material of the lid for the container is aluminum, when aluminum can be recycled, it is useful from the viewpoint of saving the mineral resource and energy from refining.

We claim:

1. A lid for a container, characterized in that said lid has a main body portion and a projected portion integrally projected from a substantially central portion of an upper surface of said main body portion, whereby an opening portion of the container and a seal plug for blocking the opening portion are covered by said lid, said lid including: a first breakable portion, annularly provided around a portion of a circumference of a base portion of said projected portion thereby dividing said circumference into said first breakable portion and a remaining portion wherein said first breakable portion is formed such that when said projected portion is bent towards said remaining portion, said projected portion detaches from said first breakable portion while remaining attached to said remaining portion; a second breakable portion provided from one end of said first breakable portion through the upper surface of said main body portion to a bottom end of an outer peripheral surface of said main body portion; a third breakable portion provided from another end of said first breakable portion to a end of an outer periphery of the upper surface of said main body portion; at least one more breakable portion provided from an intermediate point of said first breakable portion to the end of the outer periphery of the upper surface of said main body portion; a display mark for indicating a bending direction of said projected portion; and said lid for the container is integrally formed of a single material.

2. A lid for a container as set forth in claim 1, characterized in that said container is a bottle for chemical liquid.

3. The lid for a container of claim 1 wherein said single material for said lid is metal.

4. The lid for a container of claim 1 wherein said single material for said lid is a synthetic resin.

* * * * *

UNITED STATES PATENT AND TRADEMARK OFFICE

CERTIFICATE OF CORRECTION

PATENT NO. : 5,611,445

DATED : March 18, 1997

INVENTOR(S) : Takashi Kano and Seizo Rai

It is certified that error appears in the above-indentified patent and that said Letters Patent is hereby corrected as shown below:

On the title page, item [73] should read as follows:

[73] Assignee:

Mect Corporation and Rai Hatome Kogyo Co., Ltd.,
Both of Tokyo, Japan

Signed and Sealed this

Thirtieth Day of September, 1997

*Attest:*

*Attesting Officer*

BRUCE LEHMAN

*Commissioner of Patents and Trademarks*